US005950813A

United States Patent [19]

Hoskins et al.

[11] Patent Number: 5,950,813

[45] Date of Patent: Sep. 14, 1999

[54] ELECTRICAL SWITCH

[75] Inventors: Steven R. Hoskins, Walled Lake; Derrick Titus, Plymouth, both of Mich.

[73] Assignee: TRW Inc., Lyndhrust, Ohio

[21] Appl. No.: 08/946,333

[22] Filed: Oct. 7, 1997

[51] Int. Cl.[6] ..... H01H 13/52

[52] U.S. Cl. ..... 200/521; 200/16 R; 200/539

[58] Field of Search ..... 200/16 R–160, 200/519–521, 530–539, 329, 341, 344, 345

[56] References Cited

U.S. PATENT DOCUMENTS

| | | | |
|---|---|---|---|
| 1,248,575 | 12/1917 | Trood . | |
| 2,584,390 | 2/1952 | Lauder | 200/54 |
| 3,431,371 | 3/1969 | Stoi et al. | 200/16 |
| 4,079,220 | 3/1978 | Wagner et al. | 200/159 R |
| 4,314,124 | 2/1982 | Sauer et al. | 200/328 |
| 4,451,719 | 5/1984 | Lauterburg et al. | 200/159 R |
| 5,012,056 | 4/1991 | Abel et al. | 200/519 |

*Primary Examiner*—Michael Friedhofer
*Attorney, Agent, or Firm*—Tarolli, Sundheim, Covell, Tummino & Szabo

[57] ABSTRACT

A switch (10) for controlling flow of electric current includes a base (12) and a carrier (100) supported for movement on the base. An engagement surface (60, 80) disposed on the base (12) includes a ramp surface (66, 86) and a detent surface (64, 84) defining an opening (62, 82) disposed adjacent to the ramp surface. A detent member (130, 132) on the carrier (100) is engageable with the detent surface (64, 84) when in the detent opening (62, 82) and is engageable with the ramp surface (64, 84) when not in the detent opening. The switch (10) has a start condition in which the detent member (130, 132) is disposed in the detent opening (62, 82) and resists movement of the carrier (100) relative to the base (12). The switch (10) is movable under an actuation force from the start condition to an actuated condition in which the detent member (130, 132) is disposed on the ramp surface (66, 86). The switch (10) returns to the start condition in response to the release of the actuation force. First and second electrical contacts (120, 152) move between a first condition and a second condition upon movement of the switch between the start condition and the actuated condition.

15 Claims, 3 Drawing Sheets

ELECTRICAL SWITCH

BACKGROUND OF THE INVENTION

1. Technical Field

The present invention relates to a switch for controlling the flow of electric current. In particular, the present invention relates to a switch having tactile feedback to enable a person actuating the switch to sense when the switch has been actuated.

2. Description of the Prior Art

It is known to control an electrically operated device in a vehicle, such as a rear window defroster, with a pushbutton switch. The switch has a first condition in which two electrical contacts in the switch are not in engagement with each other. When the switch is pushed in, the electrical contacts move into engagement with each other and complete an electric circuit. The completion of the electric circuit turns the electrically operated device on or off either directly or through an intermediate device such as a relay. It is desirable that the switch provide tactile feedback so that the vehicle occupant can sense when the switch has been actuated.

SUMMARY OF THE INVENTION

The present invention is a switch for controlling flow of electric current. The switch includes a base and a carrier supported for movement relative to the base along an axis of the switch. An engagement surface disposed on a first one of the base and the carrier includes a detent surface defining a detent opening. A detent member on a second one of the base and the carrier is engageable with the detent surface when in the detent opening.

The switch has a start condition and an actuated condition. In the start condition, the detent member is disposed in the detent opening and resists movement of the carrier relative to the base. The carrier is movable relative to the base in response to the application to the carrier of an actuation force in an amount greater than a predetermined force. In the switch actuated condition, the detent member is disposed at a location spaced apart from the detent opening. The switch includes means for returning the switch to the start condition in response to the release of the actuation force on the carrier. The switch further includes first and second electrical contacts which move between a first condition and a second condition upon movement of the carrier between the start condition and the actuated condition.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
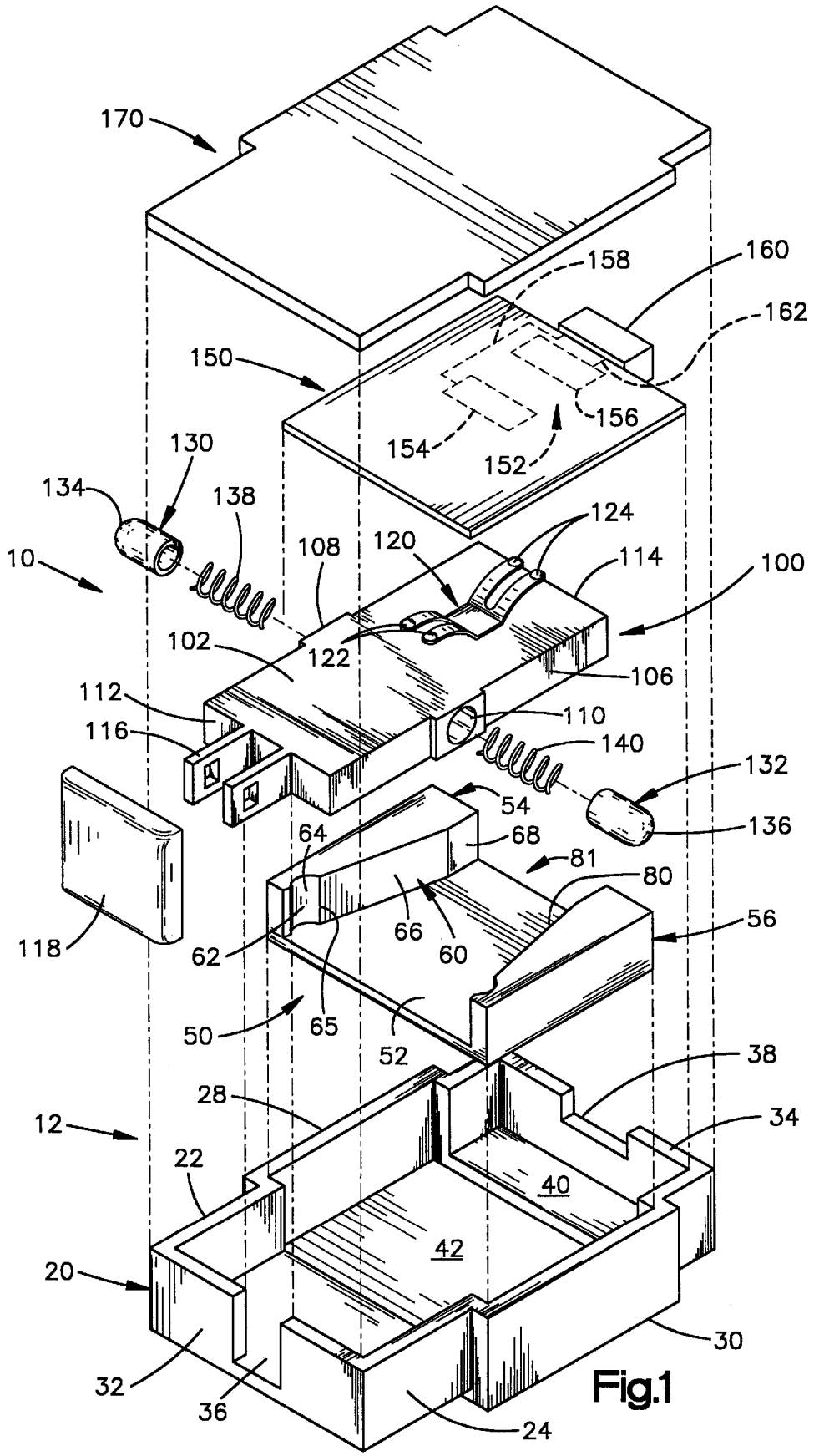
FIG. 1 is an exploded perspective view of a switch which is constructed in accordance with the present invention.

The present invention relates to a switch for controlling an electrically actuated device in a vehicle. The device may be, for example, an electric rear window defroster with a relay intermediate the switch and the defroster. As representative of the present invention, FIG. 1 illustrates a switch 10.

The switch 10 includes a base 12. The base 12 includes a housing 20 which is made from an electrically insulating material such as plastic. The housing 20 has an open, box-shaped configuration including first and second opposite side walls 22 and 24 which extend generally parallel to a longitudinal central axis 26 (FIG. 2) of the switch 10. The first side wall 22 of the housing 20 has a widened portion 28. The second side wall 24 of the housing 20 is a mirror image of the first side wall and has a widened portion 30.

The housing 20 also has first and second opposite end walls 32 and 34. An opening 36 is formed in the first end wall 32. Another opening 38 is formed in the second end wall 34. The housing 20 also includes a bottom wall 40 which interconnects the end walls 32 and 34 and the side walls 22 and 24. The bottom wall 40 has a recessed or lowered central portion 42.

The base 12 also includes a ramp assembly 50 which is received in the housing 20 between the widened portions 28 and 30 of the side walls 22 and 24. The ramp assembly 50 is formed as one piece and includes a bottom wall 52 and a pair of ramp members 54 and 56 which project upwardly from the bottom wall. The bottom wall 52 of the ramp assembly 50 is received in and overlies the recessed portion 42 of the bottom wall 40 of the housing 20.

Figure 2:
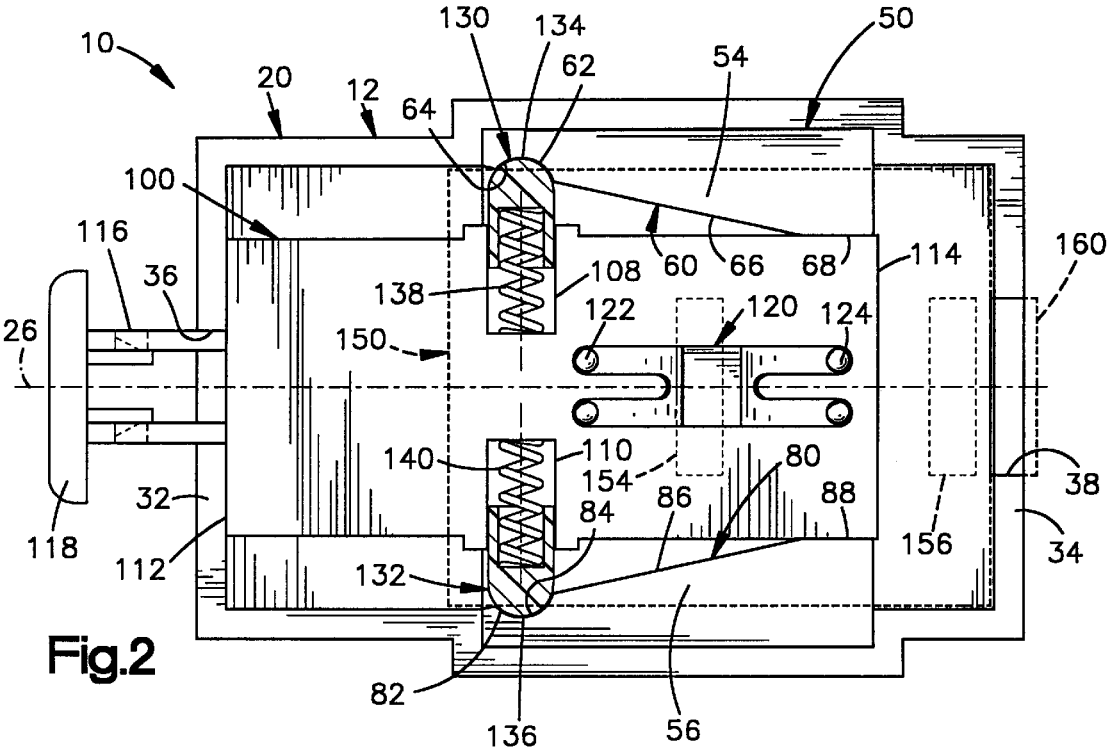
FIG. 2 is a plan view of the switch of FIG. 1 with a cover removed, showing the parts of the switch in a start condition.
Figure 3:
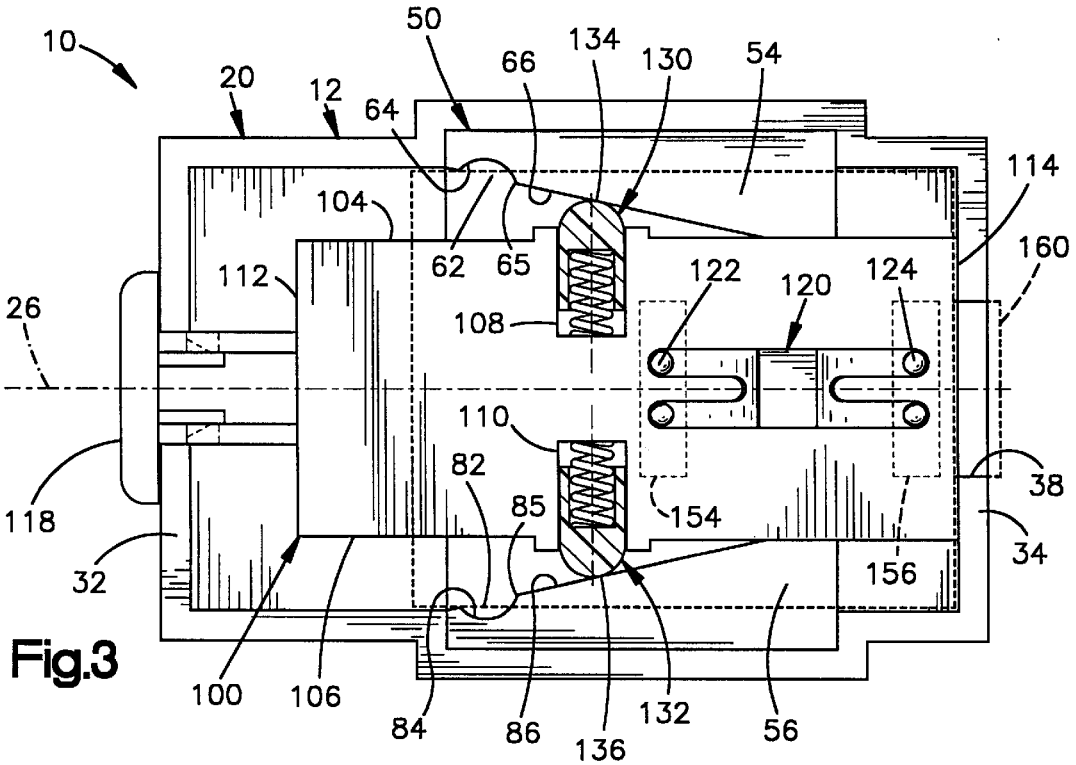
FIG. 3 is a view similar to FIG. 2 showing the parts of the switch in an actuated condition.
Figure 4:
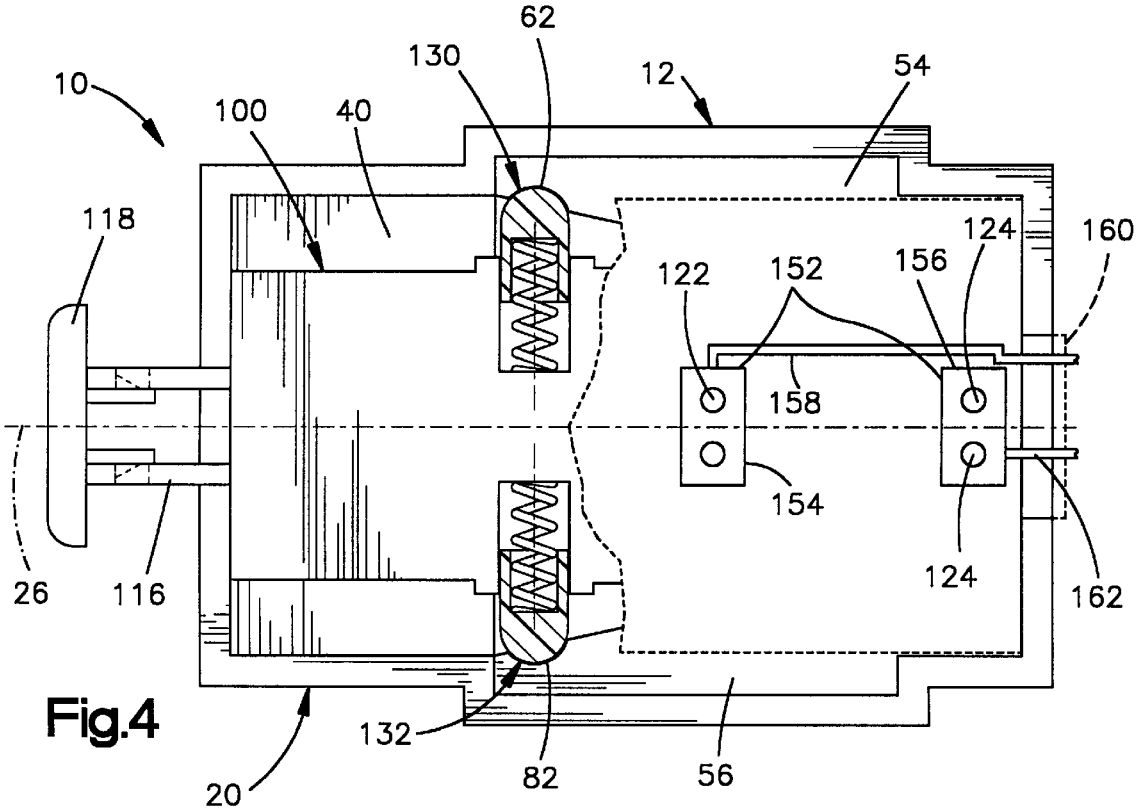
FIG. 4 is a schematic view similar to FIG. 2 showing the electrical contacts in the switch.

The first ramp member 54 has an engagement surface or inner side surface 60 which is presented toward the axis 26. The inner side surface 60 includes a cylindrical detent surface 64 which defines a first detent opening 62. The first detent opening 62 has an arcuate cross-sectional configuration as best seen in FIGS. 2–4.

The inner side surface 60 of the first ramp member 54 also includes a planar first ramp surface 66 and a planar first guide surface 68. An edge 65 forms a boundary between the first ramp surface 66 and the first detent surface 64. The first ramp surface 66 extends at an angle to the axis 26 between the first detent opening 62 and the first guide surface 68. The first guide surface 68 extends parallel to the axis 26 and is disposed closer to the axis than is the first detent opening 62. As a result, the inner side surface 60 tapers toward the axis 26 as it extends from the detent opening 62 in a direction to the right as viewed in FIGS. 2–5.

The second ramp member 56 is a mirror image of the first ramp member 54. The second ramp member 56 has an engagement surface or inner side surface 80 which is presented toward the inner side surface 60 of the first ramp member 54. A channel 81 in the base 12 is defined between the inner side surfaces 60 and 80 of the ramp members 54 and 56.

The inner side surface 80 of the second ramp member 56 includes a cylindrical second detent surface 84. The second detent surface 84 defines a second detent opening 82 in the second ramp member 56. The second detent opening 82 has an arcuate cross-sectional configuration.

The inner side surface 80 also includes a planar second ramp surface 86 and a planar second guide surface 88. An edge 85 forms a boundary between the second detent surface 84 and the second ramp surface 86. The second ramp surface 86 extends at an angle to the axis 26 between the second detent opening 82 and the second guide surface 88. The second guide surface 88 extends parallel to the axis 26 and is disposed closer to the axis than is the second detent opening 82. As a result, the inner side surface 80 tapers toward the axis 26 as it extends from the detent opening 82 in a direction to the right as viewed in FIGS. 2–5.

The switch 10 includes a carrier 100. The carrier 100 is supported on the base 12 for sliding movement relative to the base in a direction parallel to the axis 26. The carrier 100 is disposed in the channel 81 between the inner side surfaces 60 and 80 of the ramp members 54 and 56 of the ramp assembly 50.

The carrier 100 is formed as one piece from an electrically non-conducting material such as plastic. The carrier 100 has a generally rectangular configuration including a planar upper surface 102. The carrier 100 also has a planar lower surface (not shown) which overlies the bottom wall 52 of the ramp assembly 50. First and second opposite side surfaces 104 and 106 of the carrier 100 extend generally parallel to the axis 26.

A first plunger recess 108 is formed in the first side surface 104 of the carrier 100. The first plunger recess 108 has a cylindrical configuration and extends inward from the first side surface 104 in a direction toward the axis 26. A second plunger recess 110 is formed in the second side surface 106 of the carrier 100 at a location opposite the first plunger recess 108. The second plunger recess 110 has a cylindrical configuration and extends inward from the second side surface 106 in a direction toward the axis 26. The plunger recesses 108 and 110 could, alternatively, have another configuration, such as a rectangular configuration.

The side surfaces 102 and 104 of the carrier 100 extend between first and second opposite end surfaces 112 and 114 of the carrier. A pair of support fingers 116 on the carrier 100 project outwardly from the first end surface 110 of the carrier, through the opening 36 in the first end wall 32 of the housing 20. A pushbutton 118 is secured to the support fingers 116 of the carrier 100. The pushbutton 118 is manually engageable by an occupant of the vehicle in which the switch 10 is mounted to effect axial sliding movement of the carrier 100 relative to the base 12.

The switch 10 includes a first contact or movable contact 120 which is formed as one piece from an electrically conductive material such as metal. The movable contact 120 is fixed on the upper surface 102 of the carrier 100 for movement with the carrier.

The movable contact 120 includes a first pair of resilient fingers 122 which project upward from the carrier 100 and in a direction toward the first end portion 112 of the carrier. A second pair of resilient fingers 124 of the movable contact 120 project upward from the carrier 100 and in a direction toward the second end portion 114 of the carrier. The second fingers 124 are spaced apart axially from the first fingers 122 by a predetermined distance. The second fingers 124 are electrically connected with the first fingers 122.

The switch 10 further includes a pair of plungers 130 and 132. The first plunger 130 has a bullet-shaped configuration including a hemispherical outer end surface 134. The first plunger 130 is supported in the first plunger recess 108 in the carrier 100 for sliding movement relative to the carrier in a direction perpendicular to the axis 26.

The second plunger 132 is identical to the first plunger and has a bullet-shaped configuration including hemispherical outer end surface 136. The second plunger 132 is supported in the second plunger recess 110 in the carrier 100 for sliding movement relative to the carrier in a direction perpendicular to the axis 26.

The switch includes a pair of compression springs 138 and 140 which bias the plungers 130 and 132, respectively, against the ramp members 54 and 56, respectively. The first spring 138 acts between the carrier 100 and the first plunger 130 and biases the first plunger outwardly, in a direction perpendicular to and away from the axis 26 and toward the first ramp member 54. As a result, the outer end surface 134 of the first plunger 130 engages the inner side surface 60 of the first ramp member 54. The second spring 140 acts between the carrier 100 and the second plunger 132 and biases the second plunger outwardly, in a direction perpendicular to and away from the axis 26 and toward the second ramp member 56. As a result, the outer end surface 136 of the second plunger 132 engages the inner side surface 80 of the second ramp member 56.

The switch 10 includes a printed circuit board or PC board 150 which is fixed in position on the base 12 in a manner not shown. The PC board 150 includes a second contact or fixed contact 152 of the switch 10. The fixed contact 152 comprises a pair of electrical contact pads 154 and 156 formed on the side of the PC board which faces the carrier 100. The contact pads 154 and 156 are spaced apart axially by a predetermined distance. The spacing between the contact pads 154 and 156 is equal to the spacing between the first fingers 122 and the second fingers 124 on the movable contact 120.

A first conductive trace 158 extends between the first contact pad 154 and an electrical connector 160 on the PC board 150. A second conductive trace 162 extends between the second contact pad 156 and the electrical connector 160. The conductive traces 158 and 162 are electrically connected with terminals (not shown) of the connector 160. The electrical connector 160 has a known configuration for electrically connecting the switch 10 with the electric circuitry of the vehicle in which the switch is mounted. The PC board 150 could, alternatively, be replaced with another conductive device, such as an insert molded terminal grid, for example.

The switch 10 also includes a cover 170 which is similar in configuration to the bottom wall 40 of the housing 20. The cover 170 forms a top wall of the housing 20 and is fixed to the housing in a known manner (not shown). The cover 170 closes the switch 10 and secures the other parts of the switch in position in the housing 20.

FIG. 2 illustrates the parts of the switch 10 when the switch is in a start condition. The carrier 100 is in a start position relative to the base 12 in which the first end surface 112 of the carrier is in abutting engagement with the first end wall 32 of the housing 20. The second end surface 114 of the carrier 100 is spaced apart from the second end wall 32 of the housing 20. The support fingers 116 on the carrier 100 project through the opening 36 in the first end wall 32 of the housing 20. The pushbutton 118 is spaced outwardly from the first end wall 32 of the housing 20.

The side surfaces 104 and 106 on the carrier 100 are in slidable engagement with the guide surfaces 68 and 88, respectively on the base 12. The inner side surfaces 60 and 80 on the ramp assembly 50 taper toward the carrier 100 as they extend from the detent openings 62 and 82 in a direction to the right as viewed in FIG. 2.

When the switch 10 is in the start condition, the movable contact 120 on the carrier 100 is spaced apart from the fixed contact 152 on the PC board 150. Specifically, the first fingers 122 on the movable contact 120 are spaced apart axially from the first contact pad 154 on the PC board 150, in a direction to the left as viewed in FIG. 4. The second fingers 124 on the movable contact 120 are spaced apart axially from the second contact pad 156 on the PC board 150, in a direction to the left as viewed in FIG. 4.

When the switch 10 is in the start condition, the first spring 138 biases the first plunger 130 into the first detent opening 62 in the first ramp member 54. The outer end surface 134 of the first plunger 130 is in engagement with the first detent surface 64 on the first ramp member 54. The second spring 140 biases the second plunger 132 into the second detent opening 82 in the second ramp member 56. The outer end surface 136 of the second plunger 132 is in engagement with the second detent surface 84 on the second ramp member 56.

The engagement of the plungers 130 and 132 in the detent openings 62 and 82, respectively, resists axial sliding movement of the carrier 100 relative to the ramp members 54 and 56 and, thereby, relative to the base 12. The switch 10 is maintained in the start condition shown in FIG. 2 unless an axially directed actuation force greater than a predetermined force is applied to the carrier 100.

To actuate the switch 10, an occupant of the vehicle in which the switch is mounted applies an actuation force greater than the predetermined force to the pushbutton 118, in a direction to the right as viewed in FIGS. 2 and 3. The actuation force applied to the pushbutton 118 is transmitted to the carrier 100 and, through the carrier, to the plungers 130 and 132. The actuation force overcomes the resistance to movement caused by the engagement of the plungers 130 and 132 in the detent openings 62 and 82. The carrier 100 slides axially in the channel 81 between the ramp members 54 and 56, in a direction toward the second end wall 34 of the housing 20, that is, to the right as viewed in FIGS. 2–5. The side surfaces 104 and 106 on the carrier 100 slide along the guide surfaces 68 and 88, respectively, on the ramp assembly 50 of the base 12.

The first plunger 130 moves from the first detent surface 64, over the edge 65, and directly onto the first ramp surface 66. The second plunger 132 moves from the second detent surface 84, over the edge 85, and directly onto the second ramp surface 86. The plungers 130 and 132 also move inwardly toward each other and toward the axis 26 as the plungers moves onto the ramp surfaces 66 and 86. As the plungers 130 and 132 move over the edges 65 and 85 and onto the ramp surfaces 66 and 86, a substantial amount of tactile feedback is provided to the person actuating the switch 10.

The inner side surfaces 60 and 80 on the ramp assembly 50 taper toward the carrier 100 as the side surfaces extend from the detent openings 62 and 82 in the direction of application of the actuation force, that is, to the right as viewed in FIGS. 2–5. This taper increases the resistance to movement of the carrier 100 and provides further tactile feedback to the person actuating the switch 10.

The switch 10 moves from the start condition shown in FIG. 2 to an actuated condition shown in FIGS. 3 and 4. The carrier 100 moves to an actuated position. The second end surface 114 of the carrier 100 engages the second end wall 34 of the housing 20 to limit further axial movement of the carrier in the direction. This engagement is felt by the person actuating the switch 10, indicating that the switch is in the actuated condition. The pushbutton 118 may also engage the first end wall 32 of the housing 20.

As the carrier 100 moves to the actuated position, the first spring 138 maintains the outer end surface 134 of the first plunger 130 in abutting engagement with the first ramp surface 66. The second spring 140 maintains the outer end surface 136 of the second plunger 132 in abutting engagement with the second ramp surface 86.

When the switch 10 moves to the actuated condition, the movable contact 120 on the carrier 100 moves into electrical contact with the fixed contact 152 on the PC board 150. Specifically, the first fingers 122 on the movable contact 120 slide into engagement with the first contact pad 154 on the PC board 150, as shown in FIG. 4. The second fingers 124 on the movable contact 120 slide into engagement with the second contact pad 156 on the PC board 150, as shown in FIG. 4.

As a result, the first contact pad 154 is electrically connected, through the movable contact 120 on the carrier 100, with the second contact pad 156. This connection completes an electric circuit so that electric current can flow between the first contact pad 154 and the second contact pad 156. Accordingly, the terminals of the electrical connector 160 are electrically connected, to change the state of the device in the vehicle electric circuitry which the switch 10 controls.

When the actuation force applied to the pushbutton 118 is released, the biasing force of the springs 138 and 140 acts to return the carrier 100 to its start position as shown in FIG. 2. Specifically, because the outer end surface 134 of the first plunger 130 is hemispherical and the ramp surface 66 does not extend parallel to the axis 26, the outwardly directed force of the first plunger includes a force component which acts in a direction toward the left as viewed in FIG. 3. Similarly, because the outer end surface 136 of the second plunger 132 is hemispherical and the ramp surface 86 does not extend parallel to the axis 26, the outwardly directed force of the second plunger includes a force component which acts in a direction toward the left as viewed in FIG. 3.

These axial force components cause the carrier 100 to slide axially in the channel 81, in a direction to the left as viewed in FIG. 3, when the actuation force applied to the pushbutton 118 is released. As the carrier 100 returns to the start condition, the movable contact 120 on the carrier 100 moves out of engagement with the fixed contact 152 on the PC board 150. This movement opens the electric circuit between the first contact pad 154 and the second contact pad 156. The plungers 130 and 132 move outwardly away from each other and away from the axis 26 as they move axially from the ramp surfaces 66 and 86, respectively, directly onto the detent surfaces 64 and 84, respectively.

The switch 10 returns to the start condition shown in FIG. 3. The first end surface 112 of the carrier 100 engages the first end wall 32 of the housing 20 to limit further axial movement of the carrier. The engagement of the plungers 130 and 132 in the detent openings 62 and 64, respectively, again resists axial sliding movement of the carrier 100 relative to the ramp members 54 and 56 and, thereby, relative to the housing 20.

Figure 5:
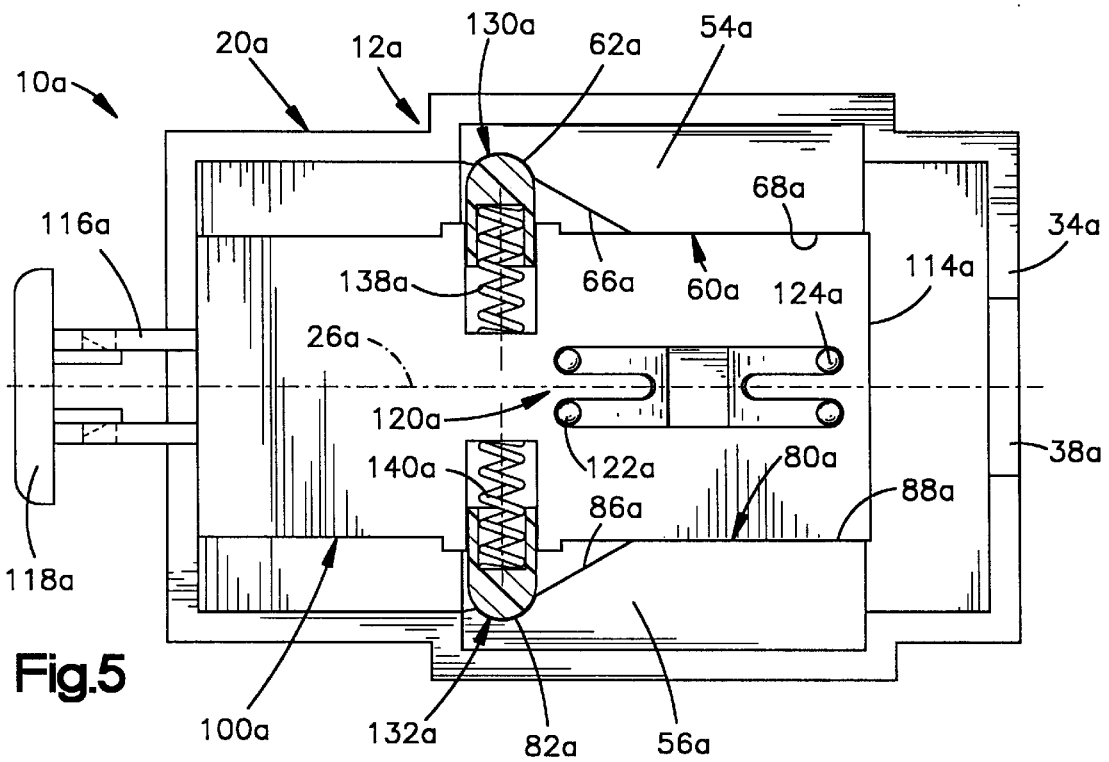
FIG. 5 is a view similar to FIG. 2 of a switch constructed in accordance with a second embodiment of the present invention.

In the switch 10 of the present invention, the ramp assembly 50 is constructed separately from the housing 20 so that interchangeable ramp assemblies can be provided for the same housing. As an example, FIG. 5 illustrates a switch 10*a* which is identical to the switch 10 (FIGS. 1–4) with the exception that the switch 10*a* (FIG. 5) includes a differently configured ramp assembly 50*a*.

The ramp assembly 50*a* includes opposed ramp surfaces 66*a* and 86*a* which extend at an angle to the axis 26*a* which is different from the angle of the ramp surfaces 66 and 86 (FIGS. 1–3). Specifically, in the ramp assembly 50*a* illustrated in FIGS. 1–4, the ramp surfaces 66 and 86 extend at an angle of approximately ten degrees to the axis 26. In the ramp assembly 50*a* illustrated in FIG. 5, the ramp surfaces 66*a* and 86*a* extend at an angle of approximately 30 degrees to the axis 26*a*. Because of this increased angle of the ramp surfaces 66*a* and 86*a*, when the carrier 100*a* is moved a given distance away from the start position relative to the ramp assembly 50*a*, the plungers 130*a* and 132*a* are moved farther toward the axis 26*a*, and the springs 138*a* and 140*a* are compressed more. Consequently, a greater actuation force is required to move the carrier 100*a* the given distance. This difference in actuation force can provide a different tactile feedback to the vehicle occupant when actuating the switch 10*a*.

From the above description of the invention, those skilled in the art will perceive improvements, changes and modifications in the invention. For example, the ramps could have a profile other than planar, to create the desired tactile feedback. Such improvements, changes and modifications within the skill of the art are intended to be covered by the appended claims.

Having described the invention, we claim:

1. A switch for controlling flow of electric current, said switch comprising:

a base;

a carrier supported for movement relative to said base;

an engagement surface on a first one of said base and said carrier, said engagement surface including a detent surface defining a detent opening and a ramp surface disposed adjacent to said detent surface;

a detent member on a second one of said base and said carrier, said detent member being engageable with said detent surface when in said detent opening, said detent member being engageable with said ramp surface when not in said detent opening;

biasing means for biasing said detent member into engagement with said engagement surface;

said switch having a start condition in which said detent member is disposed in said detent opening and resists movement of said carrier relative to said base;

said switch being actuatable from the start condition to an actuated condition in response to the application to said carrier of an actuation force in an amount greater than a predetermined force, said detent member being disposed on said ramp surface when said switch is in said actuated condition;

said ramp surface cooperating with said detent member and with said biasing means to return said switch to the start condition in response to the release of said actuation force; and first and second electrical contacts which move between a first condition and a second condition upon movement of said carrier by said actuation force.

2. A switch as set forth in claim 1 wherein said carrier is in a start position when said detent member is in said detent opening and said carrier is in an actuated position when said detent member is in engagement with said ramp surface, said ramp surface extending transverse to the direction of movement of said carrier, said biasing means biasing said carrier for axial movement in a direction toward the start position when said detent member is in engagement with said ramp surface.

3. A switch as set forth in claim 1 wherein said engagement surface is on said base and said detent member is on said carrier.

4. A switch as set forth in claim 3 wherein said detent member is movable relative to said carrier in a direction transverse to the direction of movement of said carrier.

5. A switch as set forth in claim 1 wherein said detent member comprises a plunger supported on said carrier for sliding movement relative to said carrier in response to movement of said carrier relative to said engagement surface.

6. A switch as set forth in claim 1 wherein said engagement surface includes an edge which forms a boundary between said detent surface and said ramp surface.

7. A switch as set forth in claim 1 wherein said ramp surface is planar.

8. A switch as set forth in claim 7 wherein said ramp surface tapers toward said carrier as said ramp surface extends from said detent opening in the direction of application of the actuation force.

9. A switch as set forth in claim 1 wherein said first electrical contact is fixed in position on said base and said second electrical contact is movable with said carrier relative to said first electrical contact.

10. A switch as set forth in claim 1 wherein said base comprises a base member and a ramp member separate from said base member, said ramp member including said engagement surface, said ramp member being secured in said base member.

11. A switch for controlling flow of electric current, said switch comprising:

a base having a central axis and a pair of inner side surfaces spaced apart from each other on opposite sides of said axis, each one of said inner side surfaces including a ramp surface and a detent opening disposed adjacent to said ramp surface;

a first electrical contact fixed in position on said base;

a carrier supported on said base for axial movement between said inner side surfaces of said base;

a pair of detent members on said carrier and receivable in said detent openings in said base;

biasing means on said carrier for biasing said detent members into said detent openings in said base; and a second electrical contact on said carrier and movable with said carrier relative to said base;

said carrier having a first position relative to said base in which said first and second electrical contacts are spaced apart from each other and said detent members are disposed in said detent openings to resist movement of said carrier from the first position;

said carrier being movable relative to said base, in response to the application to said carrier of an actuation force in an amount greater than a predetermined force, from the first position to a second position in which said first and second electrical contacts are in engagement with each other to establish flow of electric current between said first and second contacts;

said detent members on said carrier moving onto said ramp surfaces when said carrier is moved from the first position to the second position; and said biasing means returning said carrier to the first position in response to the release of said actuation force from said carrier.

12. A switch as set forth in claim 11 wherein each one of said inner side surfaces includes an edge disposed intermediate and forming a boundary between said ramp surface on said inner side surface and said detent opening on said inner side surface.

13. A switch as set forth in claim 12 wherein each one of said ramp surfaces is planar.

14. A switch as set forth in claim 13 wherein said ramp surfaces extend transverse to said axis and do not extend parallel to each other, said detent members moving inwardly toward said axis as said carrier moves from the first condition toward the second condition.

15. A switch as set forth in claim 11 wherein said ramp surfaces taper toward said carrier as said ramp surfaces extend from said detent openings in the direction of application of the actuation force.

* * * * *